US012006949B2

(12) United States Patent
Bourne et al.

(10) Patent No.: US 12,006,949 B2
(45) Date of Patent: Jun. 11, 2024

(54) MULTIPHASE PUMP

(71) Applicant: Sulzer Management AG, Winterthur (CH)

(72) Inventors: Matthew Bourne, Katy, TX (US); Nicholas Czemerys, Leeds (GB)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/688,404

(22) Filed: Nov. 19, 2019

(65) Prior Publication Data

US 2020/0158135 A1 May 21, 2020

(30) Foreign Application Priority Data

Nov. 21, 2018 (EP) ..... 18207457

(51) Int. Cl.
*F04D 29/54* (2006.01)
*F04D 19/02* (2006.01)
(Continued)

(52) U.S. Cl.
CPC ..... *F04D 29/54* (2013.01); *F04D 19/02* (2013.01); *F04D 29/181* (2013.01); *F04D 29/52* (2013.01)

(58) Field of Classification Search
CPC ..... F04D 19/028; F04D 3/00; F04D 19/02; F04D 29/181; F04D 29/406; F04D 29/52; F04D 29/528; F04D 29/54; F04D 29/548
See application file for complete search history.

(56) References Cited

U.S. PATENT DOCUMENTS 681,581 A * 8/1901 Richards ..... F04D 29/041 415/104
1,130,422 A * 3/1915 Mueller ..... F04D 1/063 415/199.2
(Continued)

FOREIGN PATENT DOCUMENTS

CN 104728124 A * 6/2015 ..... F04D 29/426
EP 0 486 877 A1 5/1992
(Continued)

OTHER PUBLICATIONS

Machine translation of CN 104728124, Zhang et al, published Jun. 24, 2015 (Year: 2015).*
(Continued)

*Primary Examiner* — David E Sosnowski
*Assistant Examiner* — Jason G Davis
(74) *Attorney, Agent, or Firm* — GLOBAL IP COUNSELORS, LLP

(57) ABSTRACT

A multiphase pump for conveying a multiphase process fluid from a low pressure side to a high pressure side includes an outer housing, a casing, the casing having a pump inlet and a pump outlet for the process fluid, and a pump rotor capable of rotating about an axial direction arranged within the casing, and configured to convey the process fluid from the pump inlet to the pump outlet. The casing includes a plurality of stage segments, and the plurality of stage segments include an individual stage-segment, a low pressure segment arranged at the pump inlet and a high pressure segment arranged at the pump outlet, the individual stage-segment arranged between the high pressure segment and the low pressure segment, and the plurality of stage segments being held together by a sealing support structure, the casing being arranged within the outer housing.

18 Claims, 3 Drawing Sheets

(51) Int. Cl.
*F04D 29/18* (2006.01)
*F04D 29/52* (2006.01)

(56) References Cited

U.S. PATENT DOCUMENTS 2,854,926 A * 10/1958 Haight ..... F04D 1/066 415/199.2
3,032,260 A * 5/1962 Latham ..... F01D 5/066 415/190
5,253,977 A * 10/1993 Chaix ..... F04D 29/628 415/199.5
5,385,445 A * 1/1995 McKenna ..... F04D 1/066 415/199.2
5,595,473 A * 1/1997 Nagaoka ..... F04D 29/2216 415/199.1
5,961,282 A 10/1999 Wittrisch et al.
7,828,531 B2 * 11/2010 Heng ..... F04D 29/628 417/423.15
9,482,232 B2 * 11/2016 Andersen ..... F04D 29/426
10,724,526 B2 * 7/2020 Lagas ..... F04D 29/622
2003/0075870 A1 4/2003 Meuter
2010/0098525 A1 4/2010 Guelich
2010/0119363 A1 5/2010 Sagoo et al.
2011/0008186 A1 1/2011 Palomba et al.
2015/0308444 A1 * 10/2015 Trottmann ..... B04B 5/10 415/1
2018/0223854 A1 * 8/2018 Brunvold ..... F04D 1/003
2018/0266428 A1 9/2018 Milone et al.

FOREIGN PATENT DOCUMENTS

EP 2 386 767 A2 11/2011
EP 3896288 A1 * 10/2021 ..... F04D 1/06
GB 1 561 454 A 2/1980

OTHER PUBLICATIONS

Extended European Search Report issued May 8, 2019 in corresponding European Patent Application No. 18207457.5, filed Nov. 21, 2018.

* cited by examiner

1
LP
2
51
511
71
10
81
73
72
521
3
HP
A
4, 41
42
92
6
91
52

1
2
LP
51
10
82
71, 72, 73
3
HP
A
4, 41
42
92
6
91
52

MULTIPHASE PUMP

CROSS-REFERENCE TO RELATED APPLICATION

This application claims priority to European Patent Application No. 18207457.5, filed Nov. 21, 2018, the content of which is hereby incorporated herein by reference.

BACKGROUND

Field of the Invention

The invention relates to a multiphase pump for conveying a multiphase process fluid.

Background Information

Multiphase pumps are used in many different industries, where it is necessary to convey a process fluid which comprises a mixture of a plurality of phases, for example a liquid phase and a gaseous phase. An important example is the oil and gas processing industry where multiphase pumps are used for conveying hydrocarbon fluids, for example for extracting the crude oil from the oil field or for transportation of the oil/gas through pipelines or within refineries.

SUMMARY

In view of an efficient exploitation of oil- and gas fields there is nowadays an increasing demand for pumps that can be installed and operated directly on the sea ground in particular down to a depth of 100 m, down to 500 m or even down to more than 1,000 m beneath the water's surface. Needless to say that the design of such pumps is challenging, in particular because these pumps generally operate in a difficult subsea environment for a long time period with as little as possible maintenance and service work. This requires specific measurements to minimize the amount of equipment involved and to optimize the reliability of the pump.

Fossil fuels are usually not present in pure form in oil fields or gas fields, but as a multiphase mixture which contains liquid components, gas components and possibly also solid components, such as sand. This multiphase mixture of e.g. crude oil, natural gas and chemicals can also contain seawater and a not unsubstantial proportion of sand and has to be pumped from the oil field or gas field. For such a conveying of fossil fuels, multiphase pumps are used which are able to pump a liquid-gas mixture which can also contain solid components, for example sand.

One of the challenges regarding the design of multiphase pumps is the fact that in many applications the composition of the multiphase process fluid is strongly varying during operation of the pump. For example, during exploitation of an oil field the ratio of the gaseous phase (e.g. natural gas) and the liquid phase (e.g. crude oil) is strongly varying. These variations can occur very sudden and could cause a drop in pump efficiency, vibrations of the pump or other problems. The ratio of the gaseous phase in the multiphase mixture is commonly measured by the dimensionless gas volume fraction (GVF) designating the volume ratio of the gas in the multiphase process fluid. In applications in the oil and gas industry the GVF can vary between 0% and 100%. These strong variations in the composition of the process fluid could cause that the pump is at least temporarily working outside the operating range the pump is designed for. It is a known measure for reducing the large variations in the GVF to provide a buffer tank upstream of the inlet of a multiphase pump. The multiphase process fluid to be pumped by the multiphase pump is first supplied to a buffer tank of suited volume and the outlet of the buffer tank is connected to the inlet of the pump. By this measure the strong variations of the GVF can be damped thereby improving the pump performance. Modern multiphase pumps in the oil and gas industry can handle multiphase process fluids having a GVF of up to 95% or even more.

Pumping or compression devices for multiphase mixtures with increased gas content are already known from GB-A-1 561 454, EP 0 486 877 or U.S. Pat. No. 5,961,282.

Multiphase pumps and their "vibration problems" are thematized in the EP 2 386 767. The EP 2 386 767 discloses a helico-axial pump for conveying multiphase mixtures, wherein the multiphase pump comprises a hydrodynamic stabilizing bushing with a stabilizing surface between a first part rotor and a second part rotor to form a stabilizing gap in front of the stabilizing surface. In the operating state of such a multiphase pump, a hydrodynamic stabilizing layer from a stabilizing medium can be formed in the stabilizing gap. The formation of the hydrodynamic stabilizing layer reduces or at least dampens harmful vibrations of the rotor by to a predeterminable tolerable measure.

Despite such vibrations, there is a clear desire for pumps with a higher number of compression stages, so that multiphase mixtures with higher gas content can be compressed to higher pressures, so that the compressed multiphase can be pumped more reliable.

In order to obtain a sufficiently high compression of the multiphase mixtures, a larger number of compression stages, each consisting of an impeller and a stator are provided in series (for example, up to sixteen or more compression stages). This necessity of extending the length of multiphases pumps has the decisive disadvantage that such long rotors with a plurality of compression stages are very difficult to control in terms of vibration.

In the interior of these pumps, the long rotors form a vibratory system, which in particular can form various transverse oscillation modes which can be so intense that the pump can no longer be operated at a given number of revolutions or in a certain revolution field. In addition, the efficiency of the pump can be reduced and in the worst case, even damage the pump, when the rotor begins to vibrate so strong and uncontrolled that parts of the rotor come into contact with the pump casing. The type and intensity of the vibrations of the rotor depends not only on the specific geometry but also on the operating state of the pump, the multiphase mixture to be pumped, the rotational speed of the pump and other known parameters, some of which are not exactly known so that it is hardly possible to manage the problems with the harmful vibrations of the rotor solely by adapting the geometric relationships of known pumps or by using new materials.

Regarding the vibrations of the rotor the balance of the rotor is utterly important. With the rotor possessing a high level of machine balance, much less vibrations occur (even if a very inhomogeneous fluid is pumped).

SUMMARY

Therefore, one of the challenges regarding the manufacture of multiphase pumps is the requirement to ensure that a high level of machinery balance is achieved. A high balance grade of the rotor mitigates the reduction in dampening and stiffness that a high or full gas process stream provides. By ensuring a high balance grade the multiphase pump is much more robust when the process fluid properties reduce in stiffness and damping. The current state of the art process is to balance the rotor and then seal the rotor in an axially split casing. Such a casing is a large and complex fabrication, not well suited to minimization and modularization.

Starting from the state of the art it is an object of the invention to propose an improved multiphase pump avoiding the disadvantages of the prior art. In particular, the multiphase pump shall be better protected from wear by largely avoiding harmful vibrations of the rotor. Furthermore, vibrations of the rotor shall be reduced/damped to a predeterminable degree, so that an improved run of the rotor can be achieved and the pump can be operated at higher speeds. In addition, the new multiphase pump should be able to be equipped with more compression stages, than it is possible with the multiphase pumps known from the prior art.

The subject matter of the invention satisfying this object is characterized by the features described herein.

Thus, according to the invention a multiphase pump is proposed for conveying a multiphase process fluid from a low pressure side to a high pressure side. The multiphase pump comprising an outer housing and a casing, the casing having a pump inlet and a pump outlet for the process fluid. The multiphase pump further comprises a pump rotor for rotating about an axial direction arranged within the casing, with the pump rotor being designed for conveying the process fluid from the pump inlet to the pump outlet. The multiphase pump is characterized in that the casing comprises a plurality of stage segments. The plurality of stage segments comprise an individual stage-segment, a low pressure segment arranged at the pump inlet and a high pressure segment arranged at the pump outlet, wherein the individual stage-segment is arranged between the high pressure segment and the low pressure segment. Furthermore, the plurality of stage segments are held together by a sealing support structure, wherein the casing is arranged within the outer housing. The casing therefore is the inner casing of the multiphase pump. The sealing support structure is arranged at the casing inside the housing.

That the individual stage-segment is arranged between the high pressure segment and the low pressure segment implies that the individual stage-segment is disposed in the axial direction between the high pressure segment and the low pressure segment.

That the casing of the multiphase pump according to the invention comprises the plurality stage segments means preferably, that the casing is radially split at least into the individual stage-segment, the low pressure segment arranged at the pump inlet and the high pressure segment arranged at the pump outlet.

Relating to the stage casings of radially split ring-section pumps known from the prior art, the stage segments of the invention preferably are (named according to their function): suction casing (low pressure segment), stage casing (individual stage segment; usually several of these are arranged in sequence) and discharge casing (high pressure segment). When assembled, pressure-tight connection of the casing is ensured by the sealing support structure.

In particular, the sealing support structure can be fixed to the high pressure segment and the low pressure segment. In such a setup the sealing support structure is pressurizing the stage segments by the high pressure segment and the low pressure segment and as a result fastening the individual stage-segments in between the high pressure segment and the low pressure segment. In a linear pump-arrangement the low pressure segment and the high pressure segment are preferably the end pieces of the pump casing.

The inventive multiphase pump is particularly designed with several stage segments or individual stage segments of the same type arranged in tandem. The casing is an arrangement of at least three stage segments which form the casing of the rotor.

The stage casings known from the prior art are applied in some types of multistage pumps, but not in multiphase pumps with a housing and a casing arranged in the casing. An example of a pump with several stage casings of the same type fitted in tandem arrangement is the ring-section pump. This type of pump is often used in power station applications, e.g. as a boiler feed pump and in industrial applications requiring high pressures. The individual stages of a multistage pump do not necessarily have to be arranged in tandem. The balancing of axial thrust can be enhanced by arranging the stages back to back in pairs or groups. The stage casings known from the prior art are combined with the diffuser into a single piece.

In the known multistage pumps, stage casings mostly serve as simple and cost-effective constructions for low pressure applications. The balance of the pump rotor plays a very minor role, because the process fluid themselves usually are very homogenous and comprise mainly one phase. As a result, there are almost no variations in the composition of the process fluid causing wear. Consequently, there is no need for the pump to work outside its operating range.

On the other hand, in multiphase pumps the high balance of the rotor is very important in operating the multiphase pump. By ensuring the high balance of the rotor the machine is much more robust when the process fluid properties reduce in stiffness and damping while operating the multiphase pump. The current state of the art process is to balance the rotating element and then seal and support the adjacent stationary parts with a clam shell style (axially split not radially split) inner casing. In particular the adjacent stationary parts comprise semi-circular diffuser rings.

A casing with stage casings has never been considered for a multiphase pump, because among other attributes the balancing process of rotors for multiphase pumps cannot actually be exploited to known stage casings, since the known stage casings are combined with the diffuser into a single piece, whereas multiphase pumps usually comprise separate semi-circular diffusers. Furthermore the stage casings of the prior art are not arranged in the outer housing. Therefore, with the stage casing known from the prior art first balancing the rotor and applying the casing afterwards would not be possible, since the stage casing known from the prior art are built up stage by stage with the rotor.

Accordingly, the invention is to replace the axially split inner casing of a multiphase pump with a casing that resembles to the stage casing of a ring section pump, i.e. comprising several "stage casings" (radially split segments of the staged casing), therefore a casing that is not axially split but radially split. The plurality of stage segments can be applied to/slided over the rotor segment by segment, because there is no need to disassemble the rotor to fit the stator. The invention has much simpler maintenance and ensures excellent rotor-dynamic behavior of the multiphase pump. Furthermore, the multiphase pump according to the invention has a facilitated assembly and the cost are reduced without having a negative impact on the balance of the rotor, or even improving the balance of the rotor.

The essential finding of the invention is therefore that the "stage casing" can be successfully used for multiphase pumps without disassembling the rotor and without reducing the balance of the rotor.

In addition, the casing of the pump can comprise a plurality of individual stage-segments, wherein the plurality of individual stage-segments of the multiphase pump comprises a first individual stage-segment and a second individual stage-segment. The first individual stage-segment and the second individual stage-segment are arranged in tandem between the high pressure segment and the low pressure segment. Furthermore, the plurality of stage segments are held together by a sealing support structure.

The individual stage-segments can have various different shapes. The individual stage-segments can be shaped different or similar. For example, the individual stage-segments can be individual ring-segments, wherein each specific ring-segment can have an individual axial extent.

The rotor of the multiphase pump can comprise various components. The components are for example at least one, preferably a plurality of impellers and a shaft. Whereby the plurality of impellers are arranged in series on the shaft. In addition, the plurality of impellers should be coupled torque-proof to the shaft.

It has to be noted that the multiphase pump can further comprises a diffusor. The diffusor is arranged about the shaft, wherein the diffusor is usually disposed between two adjacent impellers for directing the process fluid to the next impeller. Of course, the multiphase pump can comprise a plurality of diffusors being arranged in series about a shaft, wherein each diffusor is preferably disposed between two adjacent impellers for directing the process fluid to the next impeller. The diffuser can comprise at least one vane mounted on a hub. In some embodiments of the disclosure, at least one opening is disposed in the diffuser vanes, in the radial direction, so as to reduce or to remove hydraulic instabilities such as rotating stalls. The diffuser is arranged within the casing, upstream or downstream from the impeller. Such a diffusor can optionally be axially split into two semi-circular rings and the two semi-circular rings can be arranged about the shaft.

According to an advantageous measure, the impellers are helico-axial impellers. Helico-axial multiphase pumps can be designed and employed for downhole applications, wherein the pump is installed inside a well bore. The multiphase pump of the present invention is however not limited to use in downhole applications but is rather suitable for implementation in any standalone multiphase pump for subsea or topside application. The helico-axial pump is only one type of compressor pumps used in hydrocarbon production.

The helico-axial multiphase pump typically comprises a staged casing which can be formed as a cylinder shroud in which the shaft is journaled centrally and driven in rotation by a submersible electric motor/drive unit. A helico-axial (helical) impeller is rotationally fixed to the shaft. The helico-axial pump is typically composed of several successive stages (hydraulic cell, pump stage) wherein each stage includes an impeller section followed by a diffuser section. The impeller section comprising at least one impeller and the diffuser section comprising at least one diffuser. The diffuser can include stationary blades which extend from the shroud with to the central hub through which the shaft passes, rotationally journaled. The impeller and the diffuser each provide an annular flow passage defined on the one hand by the shroud and on the other hand by the shaft and the hub respectively. Preferably, in the impeller the sectional flow area decreases towards the diffuser as the result of an increasing impeller shaft diameter, whereas in the diffuser the sectional flow area increases towards the following impeller as the result of a decreasing hub diameter. The impeller compresses the fluid towards the diffuser, imparting an axial and a rotational component to the flow. The stationary blades in the diffuser eliminate the rotational component and return the flow to axial. In effect of a radial expansion of the flow through the diffuser the flow velocity is reduced, resulting in increase of the static pressure in the fluid.

The high balance grades are difficult to maintain when sub-assemblies are dismantled to enable subsequent assembly steps, notably of adjacent stationary parts (for example diffuser) after balancing operations of the rotor. To prevent degradation of the high balance grade, the diffusers can be axially split into two semi-circular rings and assembled around the balanced rotor.

According to a preferred embodiment, the sealing support structure is a tie rod. Whereas the tie rod can be connected to a variety of the plurality of stage segments. The tie rod should be connected to at least two stage segments to pressurize the stage segments and seal the staged pump casing. In particular, the tie rod is connected to the low pressure segment and the high pressure segment. In addition, there can be a plurality of tie rods being connected to at least two stage segments. Specifically, the tie rod can also be connected to the (intermediate) individual stage-segment or a plurality of individual stage-segments.

In the multiphase pump according to the invention the individual stage-segments, in particular the first individual stage segments and the second individual stage segments can be implemented as individual rings compressed together by the tie rod.

The stage segments of the multiphase pump can comprise a flange or a plurality of flanges to connect the tie rod or a plurality of tie rods respectively. In particular the low pressure segment can comprise a first flange and the high pressure segment can comprise a second flange, wherein the tie rod is connected to the first flange and to the second flange.

The sealing support structure of the invention assembles/compacts/retains the casing i.e. the stage segments, for example with individual stage-segments being compressed together using the tie rod (or a plurality of tie rods) connected to at least two stage segments (preferably a plurality of). In a preferred embodiment the tie rod is connected to the suction casing and a last stage diffuser.

Alternatively, the sealing support structure can be designed as individually connected casings stages. Individually connected casings stages implies that there is a structure between/disposed at two adjacent stage segments connecting these two stage segments. Therefore, the stage segments can be bolted individually to the adjacent stage segment. Whereas the first individual stage-segment is bolted to the suction casing and the second individual stage-segment is bolted to the last stage diffuser. Obviously the stage segments must not be bolted but can also be connected in any other suitable manner.

Furthermore, it is preferred, that the stage segments further comprise a third individual stage-segment, the first individual stage-segment being connected to the low pressure segment, the second individual stage-segment being connected to the high pressure segment and the third individual stage-segment being connected to the first individual stage-segment and/or the second individual stage-segment. If the individual stage-segments comprises a plurality of third individual stage-segments (i.e. intermediate individual stage-segments), then the third individual stage-segment can be connected to the first individual stage-segment and/or the second individual stage-segment and/or another third individual stage-segment.

Thus, the multiphase pump can comprise a plurality of third individual stage-segments, wherein each third individual stage-segments is connected to the adjacent individual stage-segment. So, there's kind of a chain of linked individual stage-segments, comprising a plurality of individual stage-segments.

According to a preferred embodiment the multiphase pump can comprise an impeller wear ring disposed between the impeller and the casing, and a diffuser wear ring disposed between the shaft and the diffuser. The wear ring of the impeller can be integrated into the stage segments of the casing, especially if the impeller outside diameter is able to be increased without determent to the pump's hydraulic performance.

The multiphase pump can either be in horizontal or vertical configurations. According to a preferred design the pump inlet (i.e. suction) and the pump outlet (i.e. discharge) on the pump casing are the primary connections. Preferably, the low pressure segment of the pump casing is the segment of a suction casing with the inlet and the high pressure segment is the segment with the last stage diffuser and/or a discharge casing with the outlet. The sealing support structure (for example the tie rod) can in particular be connected to the last stage diffusor or the discharge casing and the suction casing.

In the operating state, the process fluid enters the pump casing at the pump inlet passing through the suction casings hydraulic passage ways. The process fluid is transported along the length of the pump shaft via single or a plurality of impellers and diffusers, due to rotation of the rotor. The process fluid is then pushed through the last stage diffuser into the pump outlet and exits the pump casing.

As the process fluid can be a multiphase fluid (i.e. comprises a plurality of different phases), comprising varying densities and viscosities of solids, liquids and gases, a high degree of mechanical balance of the pump rotor is required to minimise adverse rotor-dynamic effects, specifically at high gas to liquid ratios, where the dampening and stiffness of the process fluid is significantly reduced compared to a liquid dominant process stream.

A pump stage or a hydraulic cell is an assembly of one impeller and one diffuser. The split diffusers retain in place, due to the pressure generated by each hydraulic cell of one impeller and one diffuser. The sealing support structure is required to generate this pressure, in particular to apply this pressure to the diffusers and the wear rings of the impeller.

According to a preferred design the multiphase pump comprises tooling which holds the diffuser halves and wear rings in place whilst the radially split segments are slid over the assembly. The invention can utilize one stage segment per hydraulic cell, but can also use longer stage segments to seal and support multiple hydraulic cells with one stage segment. At a minimum a single long (first) individual stage-segment would be used to support and seal all of the pump stages or hydraulic cells between the high pressure segment and the low pressure segment.

Usually, in the multiphase pump a plurality of horizontally juxtaposed pump stages are provided, each pump stage can comprise one stage segment (the stage casing of the pump stage), in each of which one impeller is provided. The impeller promotes the fluid, from the low-pressure side inlet of this pump stage to its high pressure side outlet, which is connected to the inlet of the next stage. All impellers are rotatably mounted on the shaft, which consequently extends through all pump stages and is driven by a suitable device. The individual pump stages are typically sealed along the common shaft by the wear rings which are stationary with respect to the radially split segments, i.e. are arranged stationary or mounted. It is a common measure that two wear rings are provided for a pump stage, namely at the side with lower pressure, a first wear ring, which surrounds a front cover of the impeller, and side with higher pressure, a second wear ring, which is fixedly secured to a partition and leads the process fluid from the outlet of the pump stage to the inlet of the next pump stage and typically includes the diffuser for the next stage.

The multiphase pump can also be designed in a back to back arrangement. In this arrangement several impellers are disposed in back-to-back arrangement on the shaft. Preferably a multiphase pump according to the invention in back to back arrangement comprises the casing having a first pump inlet, a second pump inlet and the pump outlet for the process fluid. The pump rotor is rotating about the axial direction in the operating state, with the pump rotor being designed for conveying the process fluid from the pump first pump inlet and the second pump inlet to the pump outlet. The casing comprises a plurality of stage segments. The casing being adopted for the back to back arrangement means that the stage segments comprises at least two individual stage-segments, a first and a second low pressure segment arranged at the pump first and second inlet respectively and a high pressure segment arranged at the pump outlet. Whereas, the individual stage-segments are arranged between the high pressure segment and the first and second low pressure segment respectively. Furthermore, the stage segments are held together by the sealing support structure. If the sealing support structure is designed as a tie rod, the tie rod should at least be connected to the high pressure segment and the first and second low pressure segment.

The multiphase pump according to the invention can be designed as a vertical pump with the pump rotor extending in the vertical direction. Alternatively, the multiphase pump according to the invention can be designed as a horizontal pump with the pump rotor extending perpendicular to the vertical direction, i.e. in horizontal direction.

According to a preferred configuration the multiphase pump comprises a drive unit operatively connected to the pump rotor for rotating the pump rotor, wherein the drive unit is arranged inside a housing.

In particular, the multiphase pump can be designed for subsea oil and gas conveyance.

In a preferred embodiment the multiphase pump is designed for installation on the sea ground.

BRIEF DESCRIPTION OF THE DRAWINGS

The invention will be explained in more detail hereinafter with reference to the drawings.

DETAILED DESCRIPTION OF THE EMBODIMENTS

Figure 1:
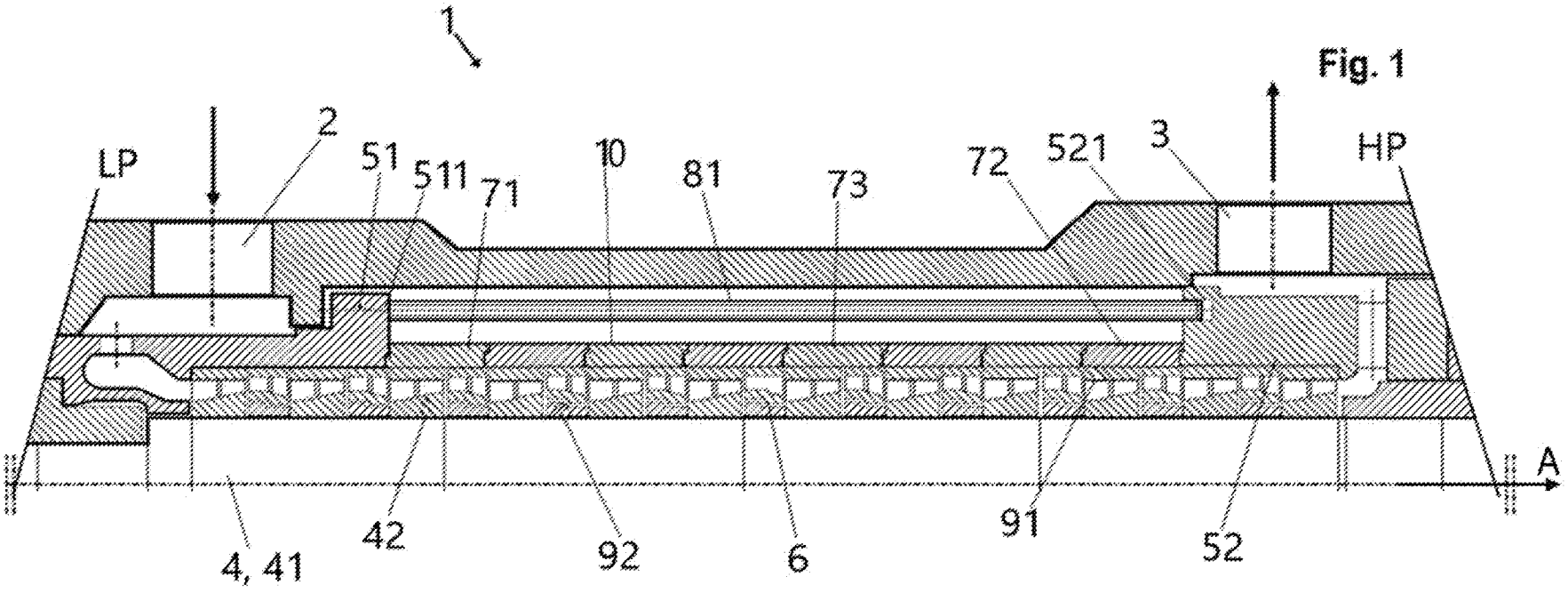
FIG. 1 is a cross-sectional view of a first embodiment of a multiphase pump according to the invention.

FIG. 1 shows a cross-sectional view of an embodiment of a multiphase pump according to the invention. The multiphase pump is designed as a centrifugal pump for conveying a multiphase process fluid from a low pressure side LP to a high pressure side HP.

In the following description reference is made by way of an example to the important application that the multiphase pump 1 is designed and adapted for being used as a subsea pump in the oil and gas industry. In particular, the multiphase pump 1 is configured for installation on the sea ground, i.e. for use beneath the water-surface, in particular down to a depth of 100 m, down to 500 m or even down to more than 1000 m beneath the water-surface of the sea. In such applications the multiphase process fluid is typically a hydrocarbon containing mixture that has to be pumped from an oilfield for example to a processing unit beneath or on the water-surface or on the shore. The multiphase mixture constituting the process fluid to be conveyed can include a liquid phase, a gaseous phase and a solid phase, wherein the liquid phase can include crude oil, seawater and chemicals, the gas phase can include methane, natural gas or the like and the solid phase can include sand, sludge and smaller stones without the multiphase pump being damaged on the pumping of the multiphase mixture.

It goes without saying that the invention is not restricted to this specific example but is related to multiphase pumps 1 in general. The invention can be used in a lot of different applications, especially in such applications where the multiphase pump is installed at locations which are difficult to access.

The casing 10 of the multiphase pump 1 comprises a pump inlet 2 through which the multiphase process fluid enters the pump at the low pressure side LP as indicated by the arrow, and a pump outlet 3 for discharging the process fluid with an increased pressure at the high pressure side HP as indicated by the arrow. Typically, the pump outlet 3 is connected to a pipe or a piping (not shown) for delivering the process fluid to another location. The pressure of the process fluid at the pump outlet 3, i.e. at the high pressure side HP, is typically considerably higher than the pressure of the process fluid at the pump inlet 2, i.e. at the low pressure side LP. A typical value for the difference between the high pressure and the low pressure side is for example 50 to 200 bar.

The casing 10 of multiphase pump 1 is designed as a radially split "staged" casing 10 with several stage segments 51, 52, 71, 72, 73, and is able to withstand the pressure generated by the multiphase pump 1 as well as the pressure exerted on the multiphase pump 1 by the environment. The several stage segments 51, 52, 71, 72, 73 comprise several different casing parts, which are connected to each other to form the casing 10. Whereby the several stage segments 51, 52, 71, 72, 73 comprise a high pressure segment 52 disposed on the high pressure side HP at an pump outlet 3, a low pressure segment 51 disposed on the low pressure side LP at an pump inlet 2, a first individual stage-segment 71, a second individual stage-segment 72 and a third individual stage-segment 73. The stage segments 51, 52, 71, 72, 73 are arranged in tandem wherein the first individual stage-segment 71, the second individual stage-segment 72 and the third individual stage-segments 73 are arranged between the low pressure segment 51 and the high pressure segment 52. The low pressure segment 51 is designed as suction casing and the high pressure segment is designed as discharge casing.

In the embodiment shown in FIG. 1 the first individual stage-segment 71 is connected to the low pressure segment 51, the second individual stage-segment 72 is disposed at the high pressure segment 52 and the plurality of third individual stage-segments 73 is disposed at the first individual stage-segment 71 and/or the second individual stage-segment 72 and/or connected to each other. The embodiment shown comprises a plurality of third individual stage-segments 73, each third individual stage-segments 71, 72, 73 being disposed at the adjacent individual stage-segment 71, 72, 73. The low pressure segment 51 comprises a first flange 511 and the high pressure segment 52 comprises a second flange 521. A tie rod 81 is disposed at the casing 1 and connected to the first flange 511 and to the second flange 521. The tie rod 81 is the sealing support structure, which puts the radial split segments 51, 52, 71, 72, 73 under pressure so that the staged casing 1 is held together.

The multiphase pump 1 further comprises a pump rotor 4 rotating about an axial direction A in an operating state of the multiphase pump. In a manner known per se the pump rotor 4 is configured for conveying the process fluid from an inlet annulus at the low pressure side LP to a discharge annulus at the high pressure side HP (not shown).

The pump rotor 4 comprises a shaft 41 rotatable about the axial direction A and one impeller (single stage pump; not shown) or a plurality of impellers 42 (multistage pump) arranged in series along the axial direction A for conveying the process fluid from the inlet 2 to the outlet 3 and thereby increasing the pressure of the process fluid. Each impeller 42 is fixed to the shaft 41 in a torque-proof manner. Each impeller 42 can be designed for example as a radial impeller or as an axial impeller or as a semi-axial impeller. Furthermore, there are a plurality of diffusors 6 disposed between two adjacent impellers. Impeller wear rings 91 are disposed between (in radial direction between) the casing 10 and the impellers 42 and diffusor wear rings 92 are disposed between (radial direction) the casing 10 and the diffusors 6

For rotating the shaft 41 of the pump rotor 4, the shaft 41 is operatively connected to a drive unit (drive) (not shown), which might be a separate unit located outside a housing of the pump 1, or which might be integrated into the housing. For subsea applications the drive unit is usually arranged inside the housing.

Using the drive unit, the pump rotor 4 is driven during operation of the pump 1 for a rotation about the axial direction A that is defined by the longitudinal axis of the pump rotor 4.

Figure 2:
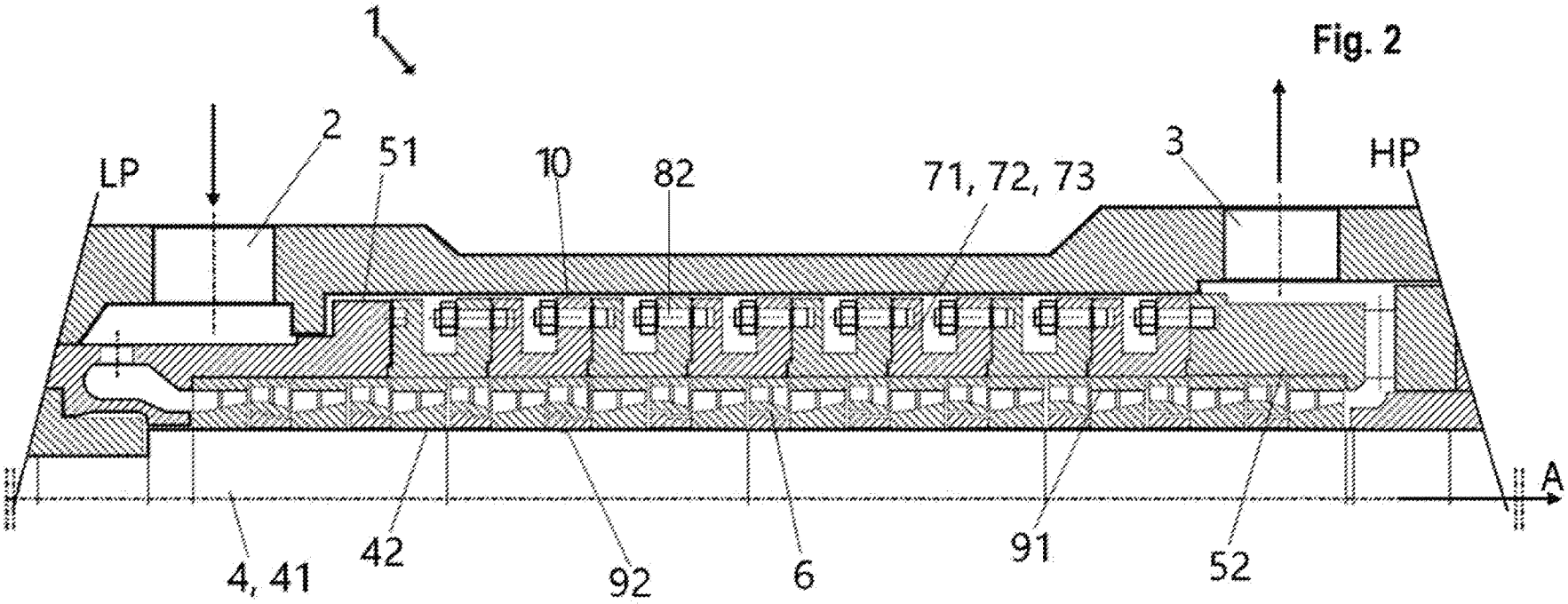
FIG. 2 is a cross-sectional view of a second embodiment of a multiphase pump according to the invention.

FIG. 2 shows a cross-sectional view of a second embodiment of a multiphase pump according to the invention. FIG. 2 shows a similar structure to FIG. 1, but a different sealing support structure is used.

The embodiment shown in FIG. 2 has individually bolted stage segments where each stage segment 51, 52, 71, 72, 73 is individually bolted to the adjacent stage segment 51, 52, 71, 72, 73 by a sealing support structure 82, and the first and last stage casing bolted to the suction casing/low pressure segment 51 and last stage diffuser/high pressure segment 52 respectively by the sealing support structure 82.

The individual stage-segments 71, 72, 73 are disposed between the high pressure segment 52 and the low pressure segment 51.

It goes without saying that the multiphase pump 1 according to the invention can be designed as a vertical or horizontal pump with the pump rotor 4 extending in the vertical or horizontal direction respectively, i.e. perpendicular to the direction of gravity.

Figure 3:
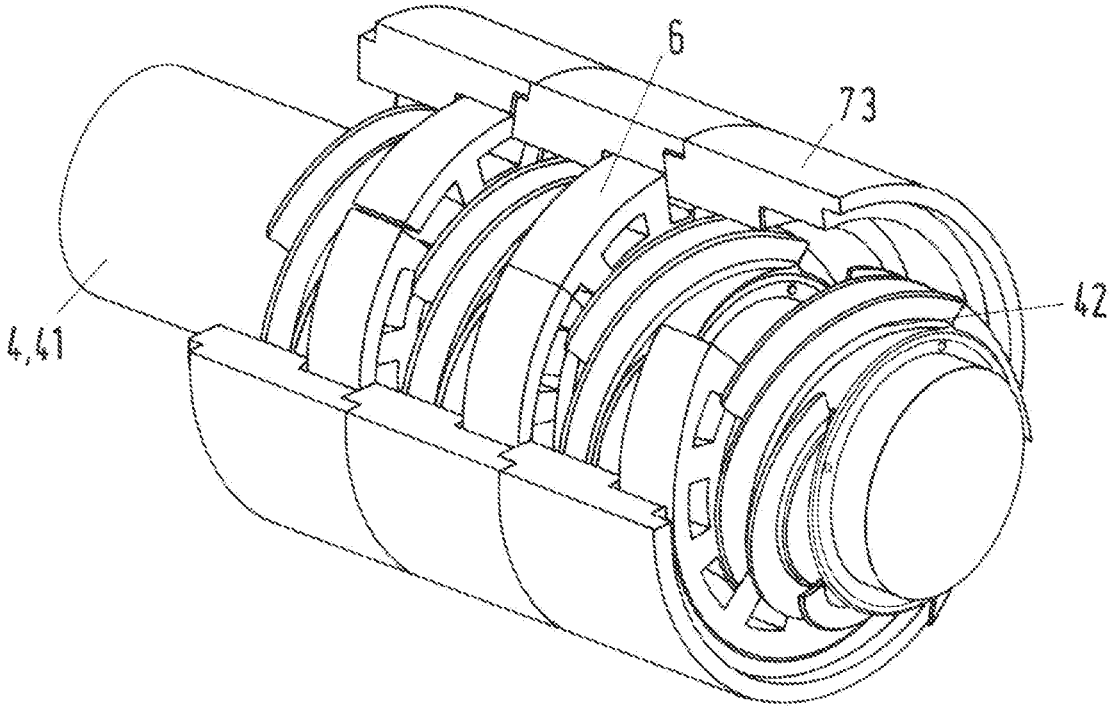
FIG. 3 is an embodiment of a multiphase pump according to the invention with an axially split diffusor.

FIG. 3 shows an embodiment of a multiphase pump according to the invention with an axially split diffusor 6.

The multiphase pump comprises a plurality of diffusors 6 which are arranged in series about a shaft 41, wherein each diffusor 6 is disposed between two adjacent impellers 42 for directing the process fluid to the next impeller 42.

Thereby, the diffusors 6 are axially split into two semi-circular rings and the two semi-circular rings are arranged about the shaft 41.

Due to the axially split diffuser the rotor can be assembled without reducing the balance of the rotor, since the axially split diffuser "sandwiches" the rotor and then the stage segments can be slid over the top.

What is claimed:

1. A multiphase pump for conveying a multiphase process fluid from a low pressure side to a high pressure side, comprising:

an outer housing;

a casing, the casing having a pump inlet and a pump outlet for the process fluid;

a pump rotor including an impeller, and capable of rotating about an axial direction arranged within the casing, and configured to convey the process fluid from the pump inlet to the pump outlet; and a diffuser including a wear ring, the casing comprising a plurality of stage segments, and the plurality of stage segments comprising an individual stage-segment, a low pressure segment arranged at the pump inlet and a high pressure segment arranged at the pump outlet, the low pressure segment radially adjacent to at least one of the impeller or the wear ring, the individual stage-segment arranged between the high pressure segment and the low pressure segment, and the plurality of stage segments being held together by a sealing support disposed inside the outer housing, the casing being arranged within the outer housing, the low pressure segment including a flange to receive the sealing support, the flange having a first end disposed at a first radial plane and a second end disposed at a second radial plane, both the first and second ends being radially adjacent to at least one of the impeller or the wear ring along the first and second radial planes, respectively.

2. The multiphase pump in accordance with claim 1, wherein the individual stage-segment is a first individual stage-segment of a plurality of individual stage-segments, and the plurality of individual stage-segments includes a second individual stage-segment, the first individual stage-segment and the second individual stage-segment being arranged in tandem between the high pressure segment and the low pressure segment, and the plurality of stage segments are held together by the sealing support.

3. The multiphase pump in accordance with claim 2, wherein the plurality of individual stage-segments further comprises a third individual stage-segment, the first individual stage-segment being connected to the low pressure segment, the second individual stage-segment being connected to the high pressure segment and the third individual stage-segment being connected to the first individual stage-segment or the second individual stage-segment.

4. The multiphase pump in accordance with claim 3, wherein the third individual stage-segment is one of a plurality of third individual stage-segments, each third individual stage-segment being connected to an adjacent individual stage-segment of the plurality of individual stage-segments.

5. The multiphase pump in accordance with claim 1, wherein the pump rotor comprises a shaft, and the impeller is one of a plurality of impellers arranged in series on the shaft.

6. The multiphase pump in accordance with claim 5, wherein the diffusor is arranged about the shaft, and is disposed between two adjacent impellers of the plurality of impellers for directing the process fluid to the next impeller.

7. The multiphase pump in accordance with claim 6, wherein the wear ring includes two semi-circular rings, the diffusor is axially split into the two semi-circular rings and the two semi-circular rings are arranged about the shaft.

8. The multiphase pump in accordance with claim 5, wherein the individual stage-segment is one of a plurality of first individual stage-segments of a plurality of individual stage-segments, and the plurality of individual stage-segments includes a plurality of second individual stage-segments, the first individual stage segments and the second individual stage segments are individual rings compressed together by the sealing support.

9. The multiphase pump in accordance with claim 5, wherein the impellers are helico-axial impellers.

10. The multiphase pump in accordance with claim 5, further comprising an impeller wear ring disposed between an impeller of the plurality of impellers and the casing, and the wear ring is disposed between the shaft and the diffuser.

11. The multiphase pump in accordance with claim 1, wherein the sealing support is a tie rod, the tie rod being connected to a multiplicity of the plurality of stage segments.

12. The multiphase pump in accordance with claim 11, wherein the flange is a first flange and the high pressure segment comprises a second flange, the tie rod being connected to the first flange and to the second flange.

13. The multiphase pump in accordance with claim 1, wherein the multiphase pump is a vertical pump with the pump rotor extending in a vertical direction.

14. The multiphase pump in accordance with claim 1, further comprising a drive operatively connected to the pump rotor, the drive configured to rotate the pump rotor, the drive being arranged inside the outer housing of the multiphase pump.

15. The multiphase pump in accordance with claim 1, wherein the multiphase pump is configured to be installed on the sea ground.

16. The multiphase pump in accordance with claim 1, wherein the sealing support is a tie rod connected to the low pressure segment and the high pressure segment.

17. The multiphase pump in accordance with claim 1, wherein the diffuser is one of a plurality of diffusers and the sealing support is disposed between the outer housing and the diffusers.

18. The multiphase pump in accordance with claim 1, wherein the individual stage-segment is a first individual stage-segment, and the plurality of stage segments comprises a second individual stage-segment, and an entirety of the flange is radially adjacent the second individual stage-segment.

* * * * *